United States Patent [19]

Kuttruf

[11] Patent Number: 4,825,745

[45] Date of Patent: May 2, 1989

[54] ELECTROHYDRAULIC CONTROL SYSTEM

[75] Inventor: Werner Kuttruf, Wuppertal, Fed. Rep. of Germany

[73] Assignee: BW Hydraulik GmbH, Wuppertal, Fed. Rep. of Germany

[21] Appl. No.: 208,415

[22] Filed: Jun. 17, 1988

[30] Foreign Application Priority Data

Jun. 19, 1987 [DE] Fed. Rep. of Germany ..... 3720266

[51] Int. Cl.[4] ..... F15B 15/22

[52] U.S. Cl. ..... 91/24; 91/47; 91/386; 91/385; 91/359; 91/417 R; 91/382

[58] Field of Search ..... 91/6, 47, 48, 277, 386, 91/359, 385, 389, 417 R, 235, 321, 24, 382, 20

[56] References Cited

U.S. PATENT DOCUMENTS

| | | | |
|---|---|---|---|
| 1,890,341 | 12/1932 | Singiser | 91/24 |
| 1,980,356 | 11/1934 | Raber | 91/389 |
| 2,079,904 | 5/1937 | Ernst | 91/389 |
| 2,157,240 | 5/1939 | Keel | 91/389 |
| 2,346,141 | 4/1944 | Snyder | 91/389 |
| 2,463,495 | 3/1949 | Rodeck et al. | 91/385 |
| 2,674,138 | 4/1954 | Mize | 91/417 R |
| 2,737,928 | 3/1956 | Neff et al. | 91/389 |
| 2,817,317 | 12/1957 | Dommel et al. | 91/389 |
| 2,837,059 | 6/1958 | Tomka | 91/389 |
| 2,847,879 | 8/1958 | Olson et al. | 91/389 |
| 2,891,380 | 6/1959 | Geyer et al. | 91/382 |
| 2,910,084 | 10/1959 | Franz | 91/382 |
| 2,980,070 | 4/1961 | Mrvosh, Jr. | 91/385 |
| 3,024,672 | 3/1962 | Smallpeice | 91/389 |
| 3,157,070 | 11/1964 | Heidrich | 91/24 |
| 3,171,330 | 3/1965 | McCombs, Jr. | 91/385 |
| 3,266,379 | 8/1966 | Kreuter | 91/382 |
| 3,363,514 | 1/1968 | Ramcke | 91/24 |
| 3,575,209 | 4/1971 | Kast | 91/389 |
| 3,734,202 | 5/1973 | Gyongyosi | 91/419 |
| 3,872,773 | 3/1975 | Denker | 91/417 R |
| 4,424,674 | 1/1984 | Geier et al. | 91/24 |
| 4,561,344 | 12/1985 | Klocke et al. | 91/417 R |
| 4,667,569 | 5/1987 | Nakamura | 91/417 R |
| 4,673,162 | 6/1987 | Lachmann | 91/417 R |

FOREIGN PATENT DOCUMENTS

| | | | |
|---|---|---|---|
| 944237 | 5/1956 | Fed. Rep. of Germany | 91/385 |
| 2337245 | 2/1975 | Fed. Rep. of Germany | 91/24 |
| 2748716 | 5/1979 | Fed. Rep. of Germany | 91/389 |
| 1133130 | 3/1957 | France | 91/417 R |
| 0663896 | 5/1979 | U.S.S.R. | 91/417 R |

*Primary Examiner*—Robert E. Garrett
*Assistant Examiner*—Thomas Denion
*Attorney, Agent, or Firm*—Becker & Becker, Inc.

[57] ABSTRACT

An electrohydraulic control system for a hydraulic working cylinder, for example of a press, the piston of which has a main working surface and a smaller working surface on the rod side. A low-pressure circuit is provided for the feed or retraction movement of the piston, and a high-pressure circuit is provided for the loading movement at increased feed force and reduced speed. The connection or disconnection of these two circuits, when required, is produced with two 3/2 way valves that are coupled together. To control these control valves, there is provided an electrical reference motor that drives a cam disk which brings about the deflection of the coupled control slide valves of the control valves against a spring. A mechanical feedback is provided via the power piston, so that altogether a closed hydromechanical position control circuit is formed. If there is a difference between theoretical and actual values, this difference produces such a variation of the position of the control valves that via the control system of the low-pressure and high-pressure circuits connected therewith, the system endeavors to correct this difference automatically.

6 Claims, 4 Drawing Sheets

ELECTROHYDRAULIC CONTROL SYSTEM

BACKGROUND OF THE INVENTION

The present invention relates to an electrohydraulic control system for controlling a hydraulic working cylinder, for example of a press or the like, the piston of which has a main working surface and a smaller working surface on the rod side, with each working surface delimiting a pressure chamber, and with the piston being able to carry out a rapid feed movement or a loading movement in one direction and a rapid retracting movement in the opposite direction; mechanically operated control valves are provided for charging the pressure chambers with pressure.

In a hydraulic press, the movement of the press tool is produced with a hydraulic cylinder. The press tool is generally fastened to the free end of the piston of the hydraulic cylinder. At the commencement of a work cycle, the piston is brought as close as possible to the workpiece at high speed and relatively low feed force, and is then moved on at increased feed force and reduced speed. If a punch press is involved, the working feed movement ends with the ejection of the workpiece that is being punched or stamped out. After termination of the working feed movement, the piston is brought back into its initial position at high speed.

The heretofore known systems that are used for controlling such hydraulic drives are relatively complicated. Here, special difficulties arise, on the one hend with the variation in the speed of the working piston and the variation in the feed force linked therewith, and on the other hand with the reversal of the direction of movement of the piston. Path-dependent control systems used in the beginning have not proved to be satisfactory. Besides the main disadvantages of inadequate accuracy of response and the risk of variations during operation, relatively long work cycle time intervals have to be reckoned with, which of necessity lead to a correspondingly unfavorable utilization of a press or the like.

In another known control system of a hydraulic drive means, the switching-over from rapid to load feed operation occurs in a pressure-dependent manner. Here, among other things, electromagnetic pressure switches are provided that respond to the pressure-charged pressure chamber of the working cylinder and bring about charging of the pressure chamber with pressure by means of electrical signals, when required. Auxiliary equipment is necessary here for reversing the direction of the piston, so that in the case of such a control system the overall technical expenditure is very considerable. In other respects, the cycle times are also relatively great in such a control system.

It is therefore an object of the present invention to provide an improved system for controlling a hydraulic working cylinder in such a way that the disadvantages of known systems do not arise, i.e., the inventive system must be such that with a favorable power balance, the switching-over of the working piston can be carried out in a problem-free manner with regard to speed, feed pressure, and direction of movement, that the working piston can initiate each position within its stroke, that optimally short work cycle times can be achieved, and that the necessary hydraulic controls can be accomplished with simple control valves that are reliable in operation. With regard to the attainment of an advantageous power balance, only that amount of energy is intended to be used with the idle strokes so that the occurring friction is overcome and the necessary mass acceleration can be realized.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

Figure 1:
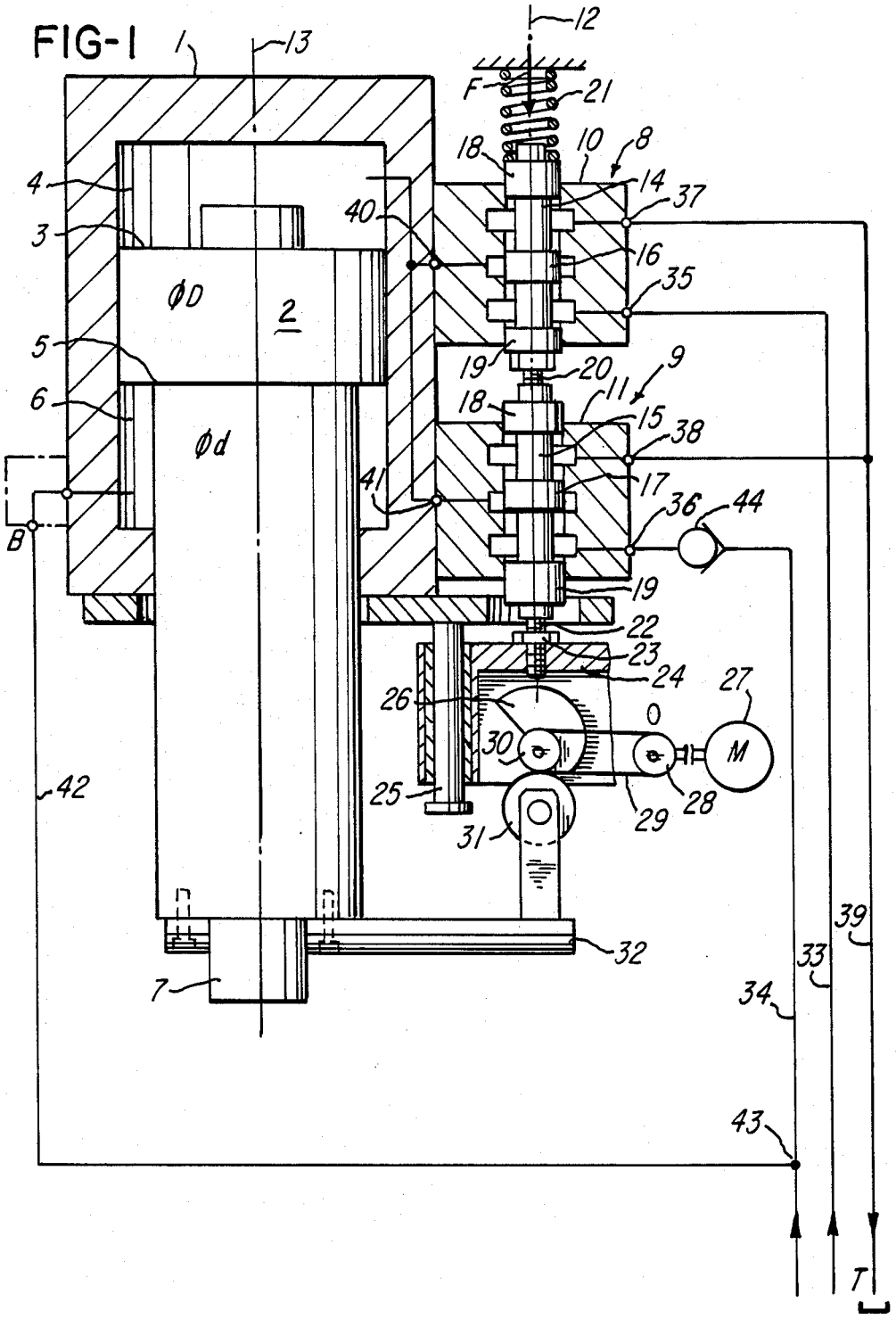
FIG. 1 shows the basic construction of an electrohydraulic control system in conjunction with a working cylinder for the operating condition "corrected rest position"

The electrohydraulic control system is characterized primarily by the following features:

(a) a hydraulic high-pressure circuit is provided for charging the pressure chamber associated with the main working surface in order to carry out the loading movement of the piston of the working cylinder, and a hydraulic lowpressure circuit is provided for charging the pressure chambers for carrying out the rapid feed or rapid retraction movement, (b) the high-pressure circuit is connected via a first 3/2 way valve (high-pressure control valve) to the pertaining pressure chamber, and the low-pressure circuit is likewise connected to the same pressure chamber via a second 3/2 way valve (low-pressure control valve), which is coupled to the first 3/2 way valve, while a respective third connection of the high-pressure and low-pressure control or 3/2 way valves is connected in each case to a line that leads to a tank, (c) the low-pressure circuit is connected via a non-return or check valve to the low-pressure control valve and is furthermore connected directly to the pressure chamber associated with the smaller working surface upstream ahead of the check valve, (d) with the aid of an adjustment member that is actuated by an electrical reference or nominal or theoretical value motor, the coupled control slide valves of the high-pressure and low-pressure control valves can be deflected against a spring, wherein the adjustment member is supported against an abutment that is movable in the same direction with the piston of the working cylinder, in the manner of a copying or tracing sensor, and wherein the spacing between the abutment and the coupled control slide valves is constantly variable between an initial position, which corresponds to the rest position of the high-pressure and low-pressure control valves, and a limit position, which corresponds to the maximum possible deflection of the high-pressure and low-pressure control valves, and (e) the control slide valves of the high-pressure and low-pressure control valves are, with regard to the reciprocal positions of the actuating pistons, constructed in such a way that in the rest position, the control slide valve of the low-pressure control valve is stationary prior to the release of the passage for the low-pressure circuit, and the control slide valve of the high-pressure control valve just keeps the passage for the line leading to the tank closed.

Accordingly, two pressure medium circuits are initially provided for the movement controls of the power piston, namely a low-pressure circuit for the movements at high speed, and a low-pressure circuit for the load feed operation of the piston. the pressure medium of these two circuits is in each case controlled via a 3/2 way valve, which are coupled together and are movable simultaneously. The nominal or theoretical value setting of the control valves occurs mechanically, e.g. with the aid of a cam disk. This cam disk is controlled by a nominal or theoretical value motor, which can be designed for a programmable NC or numerically controlled drive means. A mechanical feedback via the power piston is provided here, so that altogether a closed hydromechanical position control circuit is formed. If there is a difference between the theoretical and actual value, this difference produces such a variation of the position of the control valves that via the control of the low-pressure and high-pressure medium circuits connected therewith, the system endeavors to correct this difference. Details of the mode of operation of the novel electrohydraulic control system will be explained subsequently.

The high-pressure and the low-pressure control valves are advantageously arranged with their longitudinal axes parallel to the axis of the power or working cylinder, with their control slide valves being loaded at one end by the force of a compression spring and having a threaded rod at the opposite end. A holder that is guided on a guide means, for example a sliding guide, parallel to the longitudinal axis of the control slide valves, is secured to the threaded rod, with the adjustment member being mounted on the holder.

The adjustment member is preferably designed as a cam disk that has a helically extending control surface, and is rotatably mounted on the holder about an axis that extends at right angles to its path of movement and intersects the longitudinal axis of the high-pressure and low-pressure control valves. Different means than a cam disk, such as, for example an eccentric cam, a spindle/nut system, or a rack and pinion system could also be used for the mechanical determination of the theoretical value.

The abutment against which the cam disk is supported is advantageously composed of an idler pulley, the axis of rotation of which intersects the longitudinal axis of the high-pressure and low-pressure control valves parallel to the axis of rotation of the cam disk.

The response behavior between the high-pressure and low-pressure control valves is adjustable. This can be carried out, for example, with the aid of a threaded spindle,. which emanates from one control slide valve and is in reciprocal pressure contact with the other. This variability offers the possibility of being able to vary the switch-on time for the high-pressure circuit. The switching-over from low-pressure to high-pressure is dependent upon the space of time which lies between the responding of the low-pressure control valve and the switching-on of the high-pressure control valve. Owing to this automatic pressure switch-over, pressure medium is withdrawn from the high-pressure circuit only when the low-pressure circuit is overcharged.

Through the use of an appropriate reference motor, the electrohydraulic control system can be operated via a known NC control system. For example, direct current or alternating current motors with path-measuring and/or speed-measuring systems, or even so-called stepping motor, are suitable.

DESCRIPTION OF PREFERRED EMBODIMENTS

Referring now to the drawings in detail, in the case of the exemplary embodiment illustrated in the drawings, it should be assumed that this is the working cylinder 1 of a hydraulic punch press or embossing press, with the working cylinder 1 being arranged upright and immovably in the press pedestal. Guided in the working cylinder 1 is a piston 2 that can be charged on both sides and that defines with its main working surface 3 a first pressure chamber 4, and with its smaller working surface 5 a second pressure chamber 6. The free end of the piston 2 is provided with a device 7 for fastening the press tool required in each case.

Included in the electrohydraulic control system are a first 3/2 way valve, hereafter called a high-pressure control valve 8, and a second 3/2 way valve, hereafter called a low-pressure control valve 9. The housings 10 and 11 of the high-pressure and low-pressure control valves 8 and 9 are connected in a suitable way to the working cylinder 1 and are disposed in such a way that their longitudinal axes 12 run parallel to the cylinder axis 13.

Each of the two high-pressure and low-pressure control valves 8 and 9 contains a control slide valve 14 or 15 with a central actuating piston 16 or 17 and closing pistons 18 and 19 at the ends. The control slide valves 14 and 15 are in reciprocal pressure contact via an adjustable threaded spindle 20. At its top end, the control slide valve 14 butts against a helical coil compression spring 21. The free end of the control slide valve 15 is supported on a threaded rod 22 that is mounted on a holder 24 with the aid of a nut 23. A sliding guide on a rod 25, which is axially parallel to the cylinder axis 13 and is fastened by one end to the working cylinder 1 or to the press pedestal, is provided for the holder 24. This sliding guide can be of any known construction, which will not be examined here.

The holder 24 serves for the rotatable mounting of a cam disk 26 that has a helically extending control surface. The axis of rotation of the cam disk 26 extends at right angles to the path of movement of the holder 24, and at the same time intersects the longitudinal axis 12 of the high-pressure and low-pressure control valves 8 and 9. For the rotary drive of the cam disk 26 there is provided a known reversible reference motor 27, which is coupled via suitable reduction gear means to a driving wheel 28, which in turn is connected via a belt drive 29 or the like to a driving wheel 30, which is fixedly secured to the cam disk 26.

The cam disk 26 is in communication via its control surface with an idler pulley 31 that is rotatably mounted on a rod 32 of rigid shape, which is connected to the piston 2. The axis of rotation of the idler pulley 31 extends parallel to the axis of rotation of the cam disk 26 and is situated with the latter in the plane of the longitudinal axis 12.

In order to explain the exemplary embodiment, it is assumed for the sake of simplicity that the travel of the piston 2 and the path of the control slide valves 14 and 15 correspond. If they do not correspond, the mechanical feedback can be transmitted via a suitable reduction or transmission arrangement.

Electrical limit switches are advantageously used for controlling or ensuring the maintenance of the predetermined limit positions of the control slide valves 14 and 15. This measure is known technology and therefore does not need to be specially examined.

A high-pressure circuit 33 and a low-pressure circuit 34 are provided for carrying out the movements of the piston 2. Each of these two circuits 33 and 34 is connected to an input 35 or 36 of the two high-pressure and low-pressure control valves 8 and 9. The outputs 37 and 38 are connected to a line 39 that leads to the tank T. The outputs 40 and 41 for the supply of pressure medium to the cylinder 1 are connected to the pressure chamber 4 of the working cylinder 1.

As the drawing shows, the low-pressure circuit 34 is also connected via a branch line 42 to the second pressure chamber 6 of the working cylinder 1. A non-return or check valve 44 is also provided downstream behind the branch or junction 43 in the low-pressure circuit 34.

In this electrohydraulic control system, five operating conditions can be distinguished:

1. Stoppage of the piston 2 in a definite position without a load
2. Rapid feed operation
3. Load feed operation
4. Positioning of the piston 2 by counterforce, and
5. Rapid return stroke operation These operating conditions are explained in greater detail hereafter.

1. Stoppage of a piston 2 in a definite position without a load

Prerequisites:

High-pressure and low-pressure circuits are under pressure, and the cam disk 26 is in any desired position and is retained by the reference motor 27, the power piston 2 is not externally loaded.

With these prerequisites, the piston 2 is controlled or corrected as follows (see FIG. 1):

The pressure chamber 6 is constantly charged with low pressure via the line 42. If the piston 2 attempts to move inwardly, the control slide valves 14 and 15 are moved against the spring 21 by means of the feedback of the actual value. Low pressure thereby also passes into the pressure chamber 4 via the output 41. Since the effective working surface 3 is larger than the working surface 5, the piston can move outwardly at the same pressure.

If the piston 2 moves outwardly, the mechanical feedback produces movement of the holder 24 in the same direction under the action of the spring 21 and hence brings about a resetting of the control slide valves 14 and 15 of the control valves 8 and 9. The connection of the low-pressure circuit to the pressure chamber 4 is thereby severed. At the same time, the pressure chamber 4 is unloaded via the high-pressure control valve 8 and the line 39 to the tank, so that the piston 2 again attempts to travel inwardly under the influence of the pressure in the pressure chamber 6.

The control circuit is constructed under these conditions. In this operating condition, the high-pressure circuit 33 is out of operation; no high-pressure medium is consumed.

2. Rapid feed operation

Prerequisites:

High-pressure and low-pressure circuits are under pressure, and the cam disk 26 is in any desired position and is retained by the reference motor 27, power piston 2 is not externally loaded.

Figure 2:
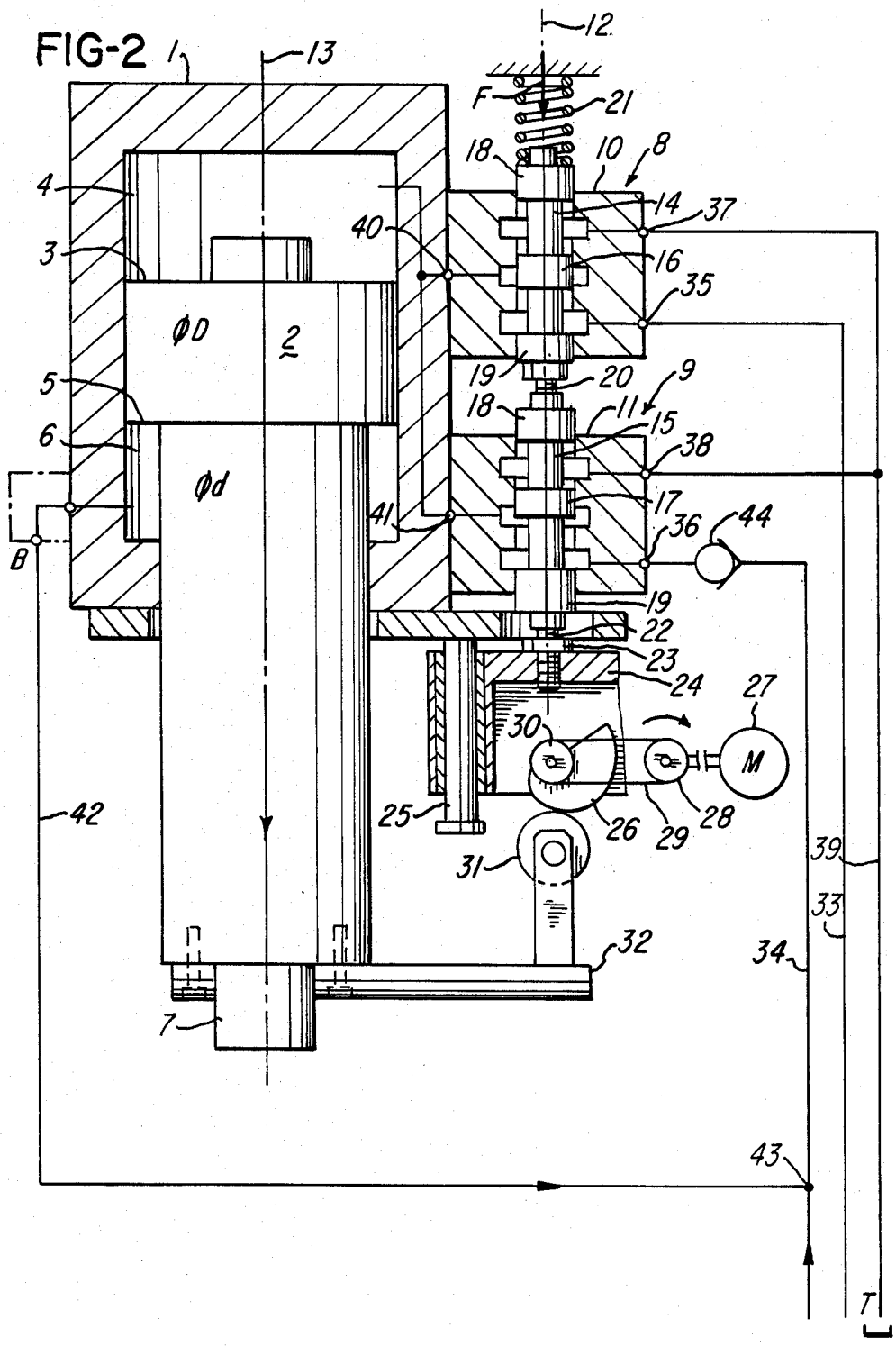
FIG. 2 shows the arrangement of FIG. 1 for the operating condition "rapid feed operation"

The piston 2, which is corrected as already described, can now be set in motion by rotating the cam disk 26 in a clockwise direction via the reference motor 27 (see FIG. 2).

Via the pitch of the cam disk 26, the holder 24 and hence the control slide valves 14 and 15 are shifted into a linear movement against the spring 21, whereby the low-pressure medium is released via the low-pressure control valve 9 to the pressure chamber 4. The piston 2 travels outwardly. The high-pressure circuit 33 is closed via the high-pressure valve 8. The quantity of pressure medium which emerges from the pressure chamber 6 passes via the line 42 into the low-pressure circuit 34.

The rate of feed of the piston 2 is initially dependent only on the predetermined nominal or theoretical value. The drag interval between the theoretical and actual value is dependent upon the increase in speed caused by the drive means.

3. Load feed operation

Prerequisites:

High-pressure and low-pressure circuits are under pressure, and the cam disk 26 is in any desired position and is retained by the reference motor 27, the power piston 2 is not externally loaded.

If the piston 2 encounters a counter-force, it can overcome this until the predetermined pressure of the low-pressure circuit is fully utilized, in the manner described under 2. If the counter-force is larger, however, the piston 2 can no longer follow the theoretical value as described under 2. However, since the cam disk 26 rotates further, a larger drag interval necessarily occurs, whereby the control slide valves 14 and 15 are shifted further against the spring 21.

Figure 3:
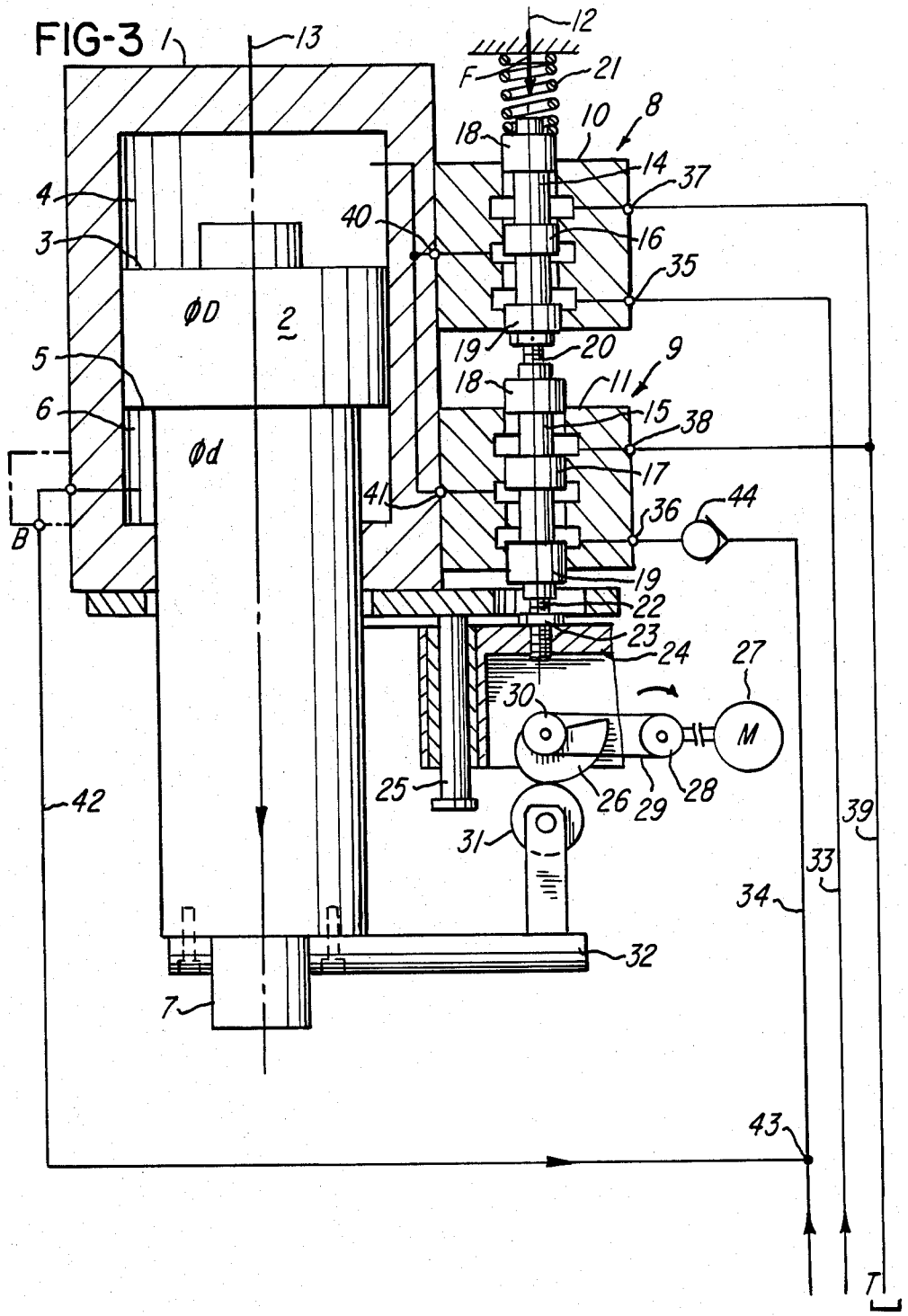
FIG. 3 shows the arrangement of FIG. 1 for the operating condition "load feed operation"
Figure 4:
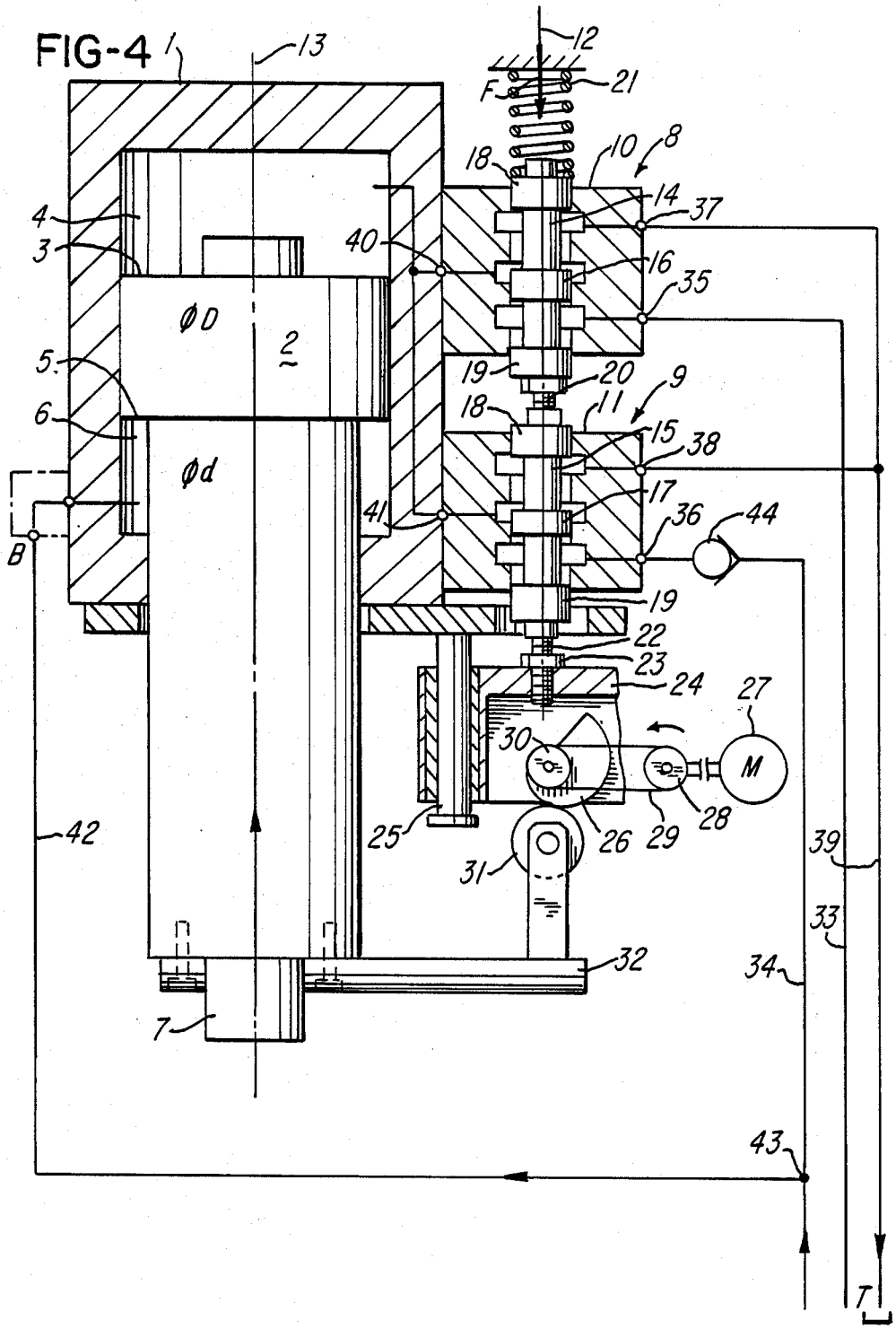
FIG. 4 shows the arrangement of FIG. 1 for the operating condition "rapid return stroke".

After passing the positive overlap of the piston 16 in the high-pressure control valve 8 (see FIG. 3), the pressure chamber 4 is charged with the pressure medium of the high-pressure circuit. There exists a second control circuit, which is shifted by the amount of the positive overlap of the piston 16 and in which the high-pressure medium is now effective. The pressure chamber 4 can be charged up to maximum pressure. The non-return valve 44 prevents the pressure medium from flowing back into the low-pressure circuit 34.

Via the reciprocal adjustability of the control slide valves 14 and 15 with the aid of the threaded spindle 20, the interval between the moment of response to the low-pressure control valve 9 and the moment of response of the high-pressure control valve 8 is variable, i.e. the switching-on of the high-pressure circuit 33 (and vice versa) can be adapted when required to the conditions existing in any given case.

If the counter-force on the piston 2 decreases again, the piston 2 reacts with an increase in speed, whereby the drag interval is necessarily reduced and as a consequence of this the high-pressure circuit 33 is isolated via the high-pressure control valve 8 and hence the supply of the high-pressure medium to the pressure chamber 4 is interrupted.

This switching-over occurs directly without any further structural elements. High dynamics and low lost power is obtained by this means.

4. Positioning under counter-force

Prerequisites:

High-pressure and low-pressure circuits are under pressure, and the cam disk 26 is in any desired position and is retained by the reference motor 27, power piston 2 is not externally loaded.

In the case of a positioning of the piston 2 with a load, the pressure chamber 4 is charged with the necessary high-pressure.

5. Rapid return stroke operation

Prerequisities:

High-pressure and low-pressure circuits are under pressure, and the cam disk 26 is in any desired position and is retained by the reference motor 27, power piston 2 is not externally loaded.

The corrected piston 2 can be set in motion by rotating the cam disk 26 in a counterclockwise direction with the aid of the reference motor 27 (see 4).

As a consequence of this rotation of the cam disk 26, the holder 24 carries out a downwardly directed movement with the piston 2 still being stationary. The control slide valves 14 and 15, which are supported against the holder 24, move in the same way under the influence of the force of the spring 21. As a result of this movement, the high-pressure and low-pressure control valves 8 and 9 are isolated. Instead, there is a connection from the pressure chamber 4 via both control valves 8 and 9 to the line 39 that leads to the tank. The pressure chamber 4 is therefore unloaded.

The pressure chamber 6 is charged with the pressure medium of the low-pressure circuit 34 via the line 42. The piston 2 can move inwardly under the influence of the low-pressure means.

In this operating condition also, the return stroke speed is initially dependent merely upon the predetermined theoretical value. The drag interval between the theoretical and actual values is dependent upon the increase in speed caused by the drive means.

The present invention is, of course, in no way restricted to the specific disclosure of the specification and drawings, but also encompasses any modifications within the scope of the appended claims.

What I claim is:

1. In an electrohydraulic control system for controlling a hydraulic working cylinder, the piston of which has a main working surface that delimits a first pressure chamber, and a smaller working surface, on a tool side, that delimits a second pressure chamber, with said piston being adapted to carry out a rapid feed movement or a loading movement in one direction, and a rapid retracting movement in the opposite direction, and with mechanically operable control valves being provided for charging said first and second pressure chambers with pressure, the improvement comprising:

a hydraulic high-pressure pressure medium circuit for charging said first pressure chamber in order to carry said loading movement of said piston;

a hydraulic low-pressure pressure medium circuit for charging said first or second pressure chambers in order to carry out said rapid feed or rapid retraction movements;

control valves that include a first 3/2 way valve in the form of a high-pressure control valve, and a second 3/2 way valve in the form of a low-pressure control valve, with each of said control valves containing a control slide valve with an actuating piston, and with said control valves being coupled to one another; said high-pressure circuit is connected via said high-pressure control valve to said first pressure chamber, and said low-pressure circuit is connected via said low pressure control valve to said first pressure chamber;

a line that leads to a tank, with each of said control valves respectively being connected to said tank;

a check valve disposed in said low-pressure circuit, which is connected to said second pressure chamber via said low-pressure control valve, which is disposed between said check valve adn said second pressure chamber;

an adjustment member, which is actuated by an electrical reference motor, for deflecting said control slides valves, which are likewise coupled, against a spring; and an abutment that is movable in the same direction with said piston, with said adjustment member being supported against said abutment in the manner of a tracing sensor; the spacing between said abutment and said coupled control slide valves is constantly variable, via said adjustment member, between an initial position, which corresponds to a rest position of said high-pressure and low-pressure control valves, and a limit position, which corresponds to the maximum possible deflection of said control valves; with regard to the reciprocal positions of said actuating pistons, said control slide valves of said high-pressure and low-pressure control valves are constructed in such a way that in said rest position, said control slide valve of said low-pressure control valve is stationary prior to release of the passage for said low-pressure circuit, and said control slide valve of said high-pressure control valve just keeps the passage for said line that leads to said tank closed.

2. An electrohydraulic control system according to claim 1, in which longitudinal axes of said high-pressure and low-pressure control valves are disposed parallel to the axis of said working cylinder; said coupled control slide valves have a first end that rests against said spring, which is in the form of a compression spring, and have an oppositely disposed second end that is supported on a threaded rod that is secured to a holder which is guided on guide means parallel to said longitudinal axis of said control valves and their slide valves, with said adjustment member being mounted on said holder.

3. An electrohydraulic control system according to claim 2, in which said guide means is a sliding guide that is secured to said working cylinder.

4. An electrohydraulic control system according to claim 2, in which said adjustment member is in the form of a cam disk that has a helically extending control surface, with said cam disk being mounted on said holder in such a way as to be rotatable about an axis that extends at right angles to its path of movement and intersects said longitudinal axis of said high-pressure and low-pressure control valves.

5. An electrohydraulic control system according to claim 4, in which said abutment is in the form of an idler pulley that is fixedly connected to said piston and has an axis of rotation that is parallel to the axis of rotation of said cam disk and intersects said longitudinal axis of said high-pressure and low-pressure control valves.

6. An electrohydraulic control system according to claim 5, in which said control slide valves of said high-pressure and low-pressure control valves are in reciprocal pressure contact with one another via a threaded spindle, the span of which is adjustable.

* * * * *